United States Patent [19]

Shiga et al.

[11] Patent Number: 4,765,149

[45] Date of Patent: Aug. 23, 1988

[54] REFRIGERATION CYCLE APPARATUS

[75] Inventors: Takashi Shiga; Hidekazu Tani; Hiroaki Hama, all of Wakayama; Hitoshi Iijima, Amagasaki, all of Japan

[73] Assignee: Mitsubishi Denki Kabushiki Kaisha, Tokyo, Japan

[21] Appl. No.: 79,496

[22] Filed: Jul. 30, 1987

[30] Foreign Application Priority Data

Aug. 4, 1986 [JP] Japan ..... 61-183813
Aug. 4, 1986 [JP] Japan ..... 61-183812
Aug. 4, 1986 [JP] Japan ..... 61-183814
Aug. 4, 1986 [JP] Japan ..... 61-183815

[51] Int. Cl.[4] ..... F25B 41/00
[52] U.S. Cl. ..... 62/174; 62/324.4
[58] Field of Search ..... 62/174, 324.4

[56] References Cited

U.S. PATENT DOCUMENTS 2,715,317 8/1955 Rhodes ..... 62/324.4 X
3,315,484 4/1967 Ross ..... 62/174
3,353,367 11/1967 Garland et al. ..... 62/174 X

FOREIGN PATENT DOCUMENTS 5582244 12/1978 Japan .
57105553 12/1980 Japan .
59-145458 2/1983 Japan .

*Primary Examiner*—William E. Wayner
*Attorney, Agent, or Firm*—Oblon, Fisher, Spivak, McClelland & Maier

[57] ABSTRACT

A refrigeration cycle apparatus comprises first and second compressors, a four-way valve, an outdoor heat exchanger, first and second expansion means, at least one indoor heat exchanger, an accumulator, a refrigerant circuit connecting these element in order, a reservoir connected to the accumulator through an overflow pipe and a refrigerant supplying pipe with a first solenoid valve and a feeding pipe with a second solenoid valve for connecting the inlet side of the expansion means to the reservoir, wherein the first and second solenoid valves are opened and closed depending on operational conditions in a refrigeration cycle.

8 Claims, 6 Drawing Sheets

REFRIGERATION CYCLE APPARATUS

BACKGROUND OF THE INVENTION

1. Field of the Invention

The present invention relates to a refrigeration cycle apparatus comprising two compressors used for a plurality of indoor heat exchangers and a outdoor heat exchanger.

2. Discussion of Backgrounds

FIG. 6 shows construction of a conventional refrigeration cycle apparatus. In FIG. 6, reference numerals 1 and 2 designate first and second compressors, a numeral 3 designates a four-way valve, a numeral 4 designates a outdoor heat exchanger, a numeral 5 designates a first expansion means to be used for heating operations, a numeral 6 designates a second expansion means to be used for cooling operations, numerals 7 and 8 respectively designate indoor heat exchangers, and a numeral 9 designates an accumulator. The above-mentioned devices are connected by refrigeration pipes in this order to form a refrigeration cycle.

A numeral 10 designates an oil level equalizing tube for connecting the shell of the first and second compressors 1, 2 at their lowest portions to equalize an amount of oil contained in the compressors. Numerals 11 and 12 designate check valves interposed between each outlet side of the compressors 1, 2 and the four-way valve 3, numerals 13 and 14 designate check valves each of which is connected in parallel to the expansion means 5 or 6, and numerals 15 and 16 designates solenoid valves each of which is provided at the inlet side of the indoor heat exchangers 7, 8 to be operated for the cooling operations.

In FIG. 6, solid arrow marks indicate the flow of a refrigerant when cooling and defrosting operations are carried out, and broken arrow marks indicate the flow of the refrigerant when the heating operations are carried out.

The operation of the conventional refrigeration cycle apparatus having the above-mentioned construction will be described.

In the cooling and defrosting operations, for instance, the refrigerant having a high temperature and a high pressure is discharged from the first and second compressors 1, 2; is passed through each of the check valves 11, 12, and is forwarded to the outdoor heat exchanger 4 by a switching operation of the four-way valve 3. The refrigerant becomes liquid by heat-exchanging in the heat exchanger 4. The liquid refrigerant is passed through the check valve 13 and is entered in the expansion means 6 where the pressure is reduced. The refrigerant having a low pressure is supplied to the indoor heat exchangers 7, 8 through the respective solenoid valves 15, 16 and the liquid refrigerant is again gasified by heat-exchanging. The refrigerant gas is returned to the first and second compressors 1, 2 through the four-way valve 3 and the accumulator 9. Thus, the refrigeration cycle for the cooling operation is obtainable by a single of the outdoor heat exchanger 4 and the indoor heat exchangers 7, 8 with the two compressors 1, 2. In the refrigeration cycle, the refrigerant is circulated while it is repeatedly subjected to liquefaction and evaporation.

In the heating operations, the refrigerant having a high temperature and a high pressure is discharged from the first and second compressors 1, 2 through their respective check valves 11, 12. The refrigerant is supplied to the indoor heat exchangers 7, 8 through the four-way valve 3. The refrigerant is liquefied by heat-exchanging in the heat exchangers 7, 8. The liquid refrigerant is then, passed through the solenoid valves 15, 16 and the check valve 14 to be forwarded into the expansion means 5 where the pressure of the liquid refrigerant is reduced. The refrigerant having a low pressure is again gasified by heat-exchanging in the outdoor heat exchanger 4. The gaseous refrigerant is again sucked into the first and second compressors 1, 2 through the four-way valve 3 and the accumulator 9. Thus, the refrigeration cycle for heating operations is attainable.

In the above-mentioned conventional refrigeration cycle apparatus, either or both of the compressors 1, 2 are selectively used depending on a load for the indoor heat exchanger during cooling or heating operations, and indoor heat exchangers 7, 8 are selected under the opening and closing control of the solenoid valves 15, 16. Namely, when one indoor heat exchanger 7 is selected, the solenoid valve 15 is opened and the solenoid valve 16 is closed. On the other hand, when the other indoor heat exchanger 8 is selected, the solenoid valve 16 is opened and the valve 15 is closed. When both of the heat exchangers 7, 8 are to be used, the solenoid valves 15 and 16 are opened.

The conventional refrigeration cycle apparatus did not have a container for storing a surplus amount of the refrigerant during its operation. Accordingly, when there was change in the load of the indoor heat exchanger, a suitable operation of the apparatus could not be obtained. For instance, when a load for cooling operation is large and both of the first and second compressors 1, 2 and both of the indoor heat exchangers 7, 8 are used, a large amount of refrigerant is required in the refrigeration cycle. On the other hand, when a load for heating operation is small wherein either of the compressors 1, 2 and either of the indoor heat exchangers 7, 8 are to be used, a small amount of the refrigerant is required. Thus, there is a great difference in an amount of the refrigerant between the load in the cooling operation and the load in the heating operation. When it is assumed that the heat-exchanging capacity of the indoor heat exchanger 7 is the same as that of the other heat exchanger 8, the optimum amount of the refrigerant required when the load for the heating operation is small, is about 30% as small as that the optimum amount of refrigerant required when the load for the cooling operation is large.

Accordingly, when an amount of the refrigerant filled in a refrigeration cycle apparatus is determined to obtain a suitable operational condition when the load for the heating operation is the minimum, there causes short of the refrigerant when the load for the cooling operation becomes the maximum, whereby the lifetime of the compressors 1, 2 is remarkably shortened because they are operated in an overheated state. On the other hand, when an amount of the refrigerant is determined to obtain a suitable operational condition when the cooling load is the maximum, the heating operation is carried out under the condition that the refrigerant is superfluous. This results in a liquid-back phenomenon in which some amount of liquid refrigerant is mixed in the gaseous refrigerant and is sucked into the compressors 1, 2 to thereby result in fault of the compressors.

Thus, in the conventional refrigeration cycle apparatus, it was difficult that a proper operational condition can be always obtained even though there was change of a load in the utilizable heat exchangers.

In the conventional apparatus, for instance, when an operation mode is changed from the heating operation to the defrosting or cooling operation, the liquid refrigerant condensed in the indoor heat exchangers 7, 8 flows in the accumulator 9 and the compressors 1, 2 through the four-way valve 3, whereby the compressors 1, 2 may be broken because a liquid compression is caused in the compressors. The same problem arises when an operation mode is changed from the defrosting or cooling operation to the heating operation. In order to eliminate such problem, it is necessary to use the accumulator 9 having a large capacity.

In the conventional refrigeration cycle apparatus, there has been found further problem as follows. For instance, when the cooling operation is stopped, the refrigerant is condensed and stays in the indoor heat exchangers 7, 8. On the other hand, when the heating operation is stopped, the refrigerant is condensed and stays in the outdoor heat exchanger 4. In either case, a large amount of the liquid refrigerant flows into the accumulator 9 when the compressors are started, and the liquid refrigerant further flows in the compressors 1, 2 in which the liquid compression is caused. The liquid compression may broke the compressors. To eliminate the problem, the capacity of the accumulator 9 should be made large.

SUMMARY OF THE INVENTION

It is an object of the present invention to provide a refrigeration cycle apparatus capable of temporarily storing a refrigerant in a refrigeration cycle depending on change in a load in a indoor heat exchanger, whereby the optimum amount of the refrigerant is maintained so that the optimum operational condition can be obtained.

It is an object of the present invention to provide a refrigeration cycle apparatus which prevents a large amount of a liquid refrigerant from flowing in an accumulator and compressors when an operation mode is changed from a cooling or defrosting operation to heating operation and vice versa, or when the compressors are started.

The foregoing and the other objects of the present invention have been attained by providing a refrigeration cycle apparatus which comprises first and second compressors, a four-way valve, a outdoor heat exchanger, first and second expansion means, at least one indoor heat exchanger, an accumulator, a refrigerant circuit connecting these elements in order, a reservoir connected to the accumulator through an overflow pipe and a refrigerant supplying pipe with a first solenoid valve and a feeding pipe with a second solenoid valve for connecting the inlet side of the expansion means to the reservoir, wherein the first and second solenoid valves are opened and closed on the basis of operational conditions in a refrigeration cycle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
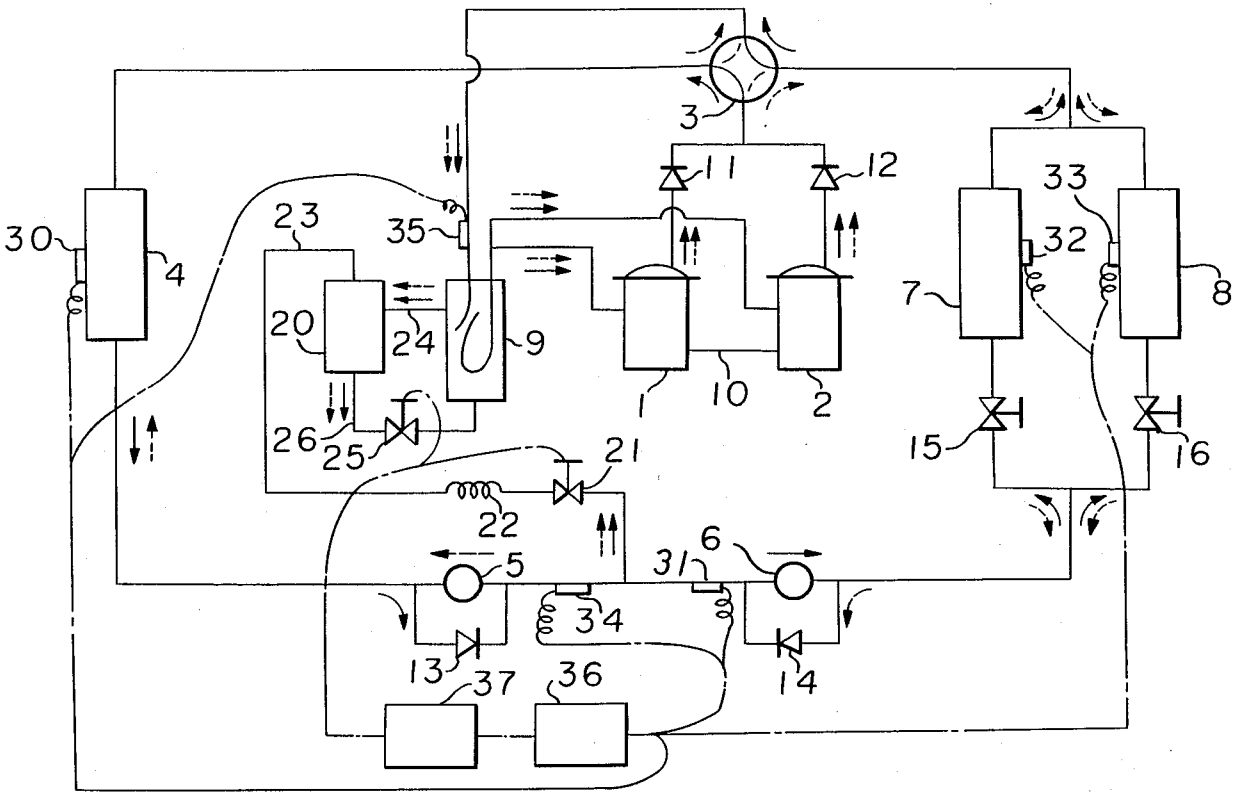
FIG. 1 is a diagram showing an embodiment of the refrigeration cycle apparatus according to the present invention.

Referring now to the drawings, wherein like reference numerals designate identical or corresponding parts throughout the several views, and more particularly to FIG. 1 thereof, there is shown in FIG. 1 an embodiment of the refrigeration cycle apparatus according to the present invention.

The refrigeration cycle apparatus of the present invention is featurized by providing a reservoir 20 as a controlling means of the quantity of the refrigerant, at the low pressure side of the apparatus and in parallel to the accumulator 9.

In more detail, the reservoir 20 is provided in such a position that the bottom of the reservoir 20 is higher than the bottom of the accumulator 9; a feeding pipe 23 with a second solenoid valve 21 and a capillary tube 22 is provided for connecting the upper end portion of the reservoir 20 to a branch provided between the expansion means 5 and 6; an overflow pipe 24 connects the upper part of the accumulator 9 to the upper part of the reservoir 20, and a supplying pipe 26 with a first solenoid valve 25 connects the bottom portion of the accumulator 9 and the bottom portion of the reservoir 20.

In FIG. 1, a reference numeral 30 designates a temperature element attached to the outdoor heat exchanger 4, which detects a condensing temperature when the cooling operation is carried out and detects an evaporating temperature when the heating operation is carried out, and a numeral 31 designates a temperature element which detects the temperature of the refrigerant at the inlet side of the expansion means 6 when the cooling operation is carried out. The indoor heat exchangers 7, 8 have respective temperature elements 32, 33 which detect an evaporating temperature when the cooling operation is carried out and detect a condensing temperature when the heating operation is carried out. A temperature element 34 is provided in the refrigeration circuit at the inlet side of the expansion means 5 to detect the temperature of the refrigerant at the inlet side when the heating operation is carried out, and a temperature detector 35 is provided in the refrigeration circuit at the inlet side of the accumulator 9 to detect the temperature of the refrigerant.

A reference numeral 36 designates a processing means for processing, on the basis of temperatures detected by the temperature elements 30 to 35, subcooling in the expansion means 6 during the cooling operation, subcooling in the expansion means 5 during the heating operation and the superheat at the inlet side of the accumulator 9. A valve control means 37 controls the solenoid valve 21 in the feeding pipe 23 and the solenoid valve 25 in the supplying pipe depending on the subcooling and the superheat which are processed by the processing means 36.

Figure 2:
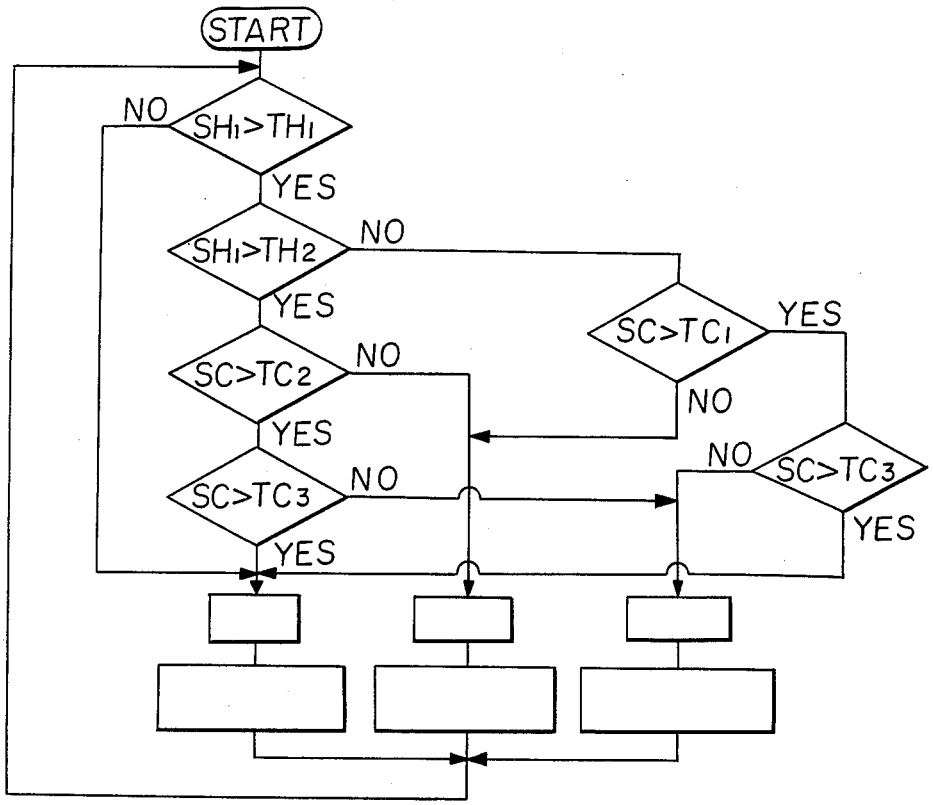
FIG. 2 is a flow chart for explaining the operation of the refrigeration cycle apparatus shown in FIG. 1.
Figure 3:
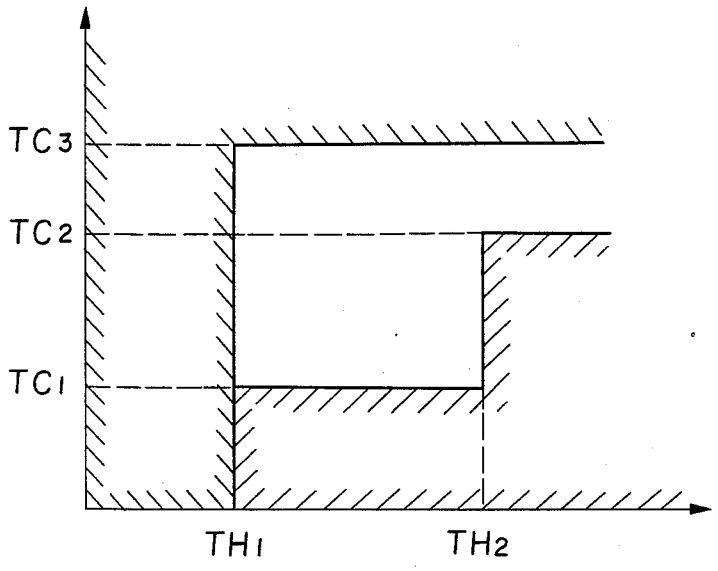
FIG. 3 is a diagram for judging an operational state of the refrigeration cycle apparatus in consideration of subcooling and superheating conditions in the apparatus.

The operation of the refrigeration cycle having the above-mentioned construction will be described with reference to FIGS. 2 and 3. FIG. 2 is a flow chart showing controlling operation of the first and second solenoid valves 25, 21 which are controlled by the valve control means 37, and FIG. 3 is a diagram for judging whether the refrigeration cycle apparatus is in a supercooling state or a superheating state.

Assuming that the refrigeration cycle apparatus contains therein a sufficient amount of the refrigerant to obtain an appropriate operational condition when the cooling operation is carried out in such condition that a load of cooling is so large as to use both of the first and second compressors 1, 2 and both of the indoor heat exchangers 7, 8. In this condition, if the load of cooling becomes small so that it is sufficient to use each one of the compressors and the indoor heat exchangers, the refrigeration cycle apparatus becomes the condition that the refrigerant is superfluous. Under the circumstances, the superheat SHI at the inlet side of the accumulator 9, which is processed by the processing unit 36 on the basis of the temperatures detected by the temperature elements 32, 33, 35 becomes small, whereas the subcooling SC at the inlet side of the expansion means 6, which is processed by the processing unit 36 on the basis of temperatures detected by the temperature elements 30, 31 becomes large. Namely, the operational condition of the refrigeration cycle apparatus falls in a region A which indicates the fact that operations are carried out with an excessive amount of the refrigerant, as shown in FIG. 3. In FIG. 3, a region C indicates an appropriate condition of operations. In order to regulate the abnormal operational condition, control is made in such a manner that as shown in FIGS. 1 and 2, the second solenoid valve 21 provided in feeding pipe 23 is opened and the first solenoid valve 25 is closed. Then, the refrigerant is supplied to the reservoir 20 through the feeding pipe 23 via the inlet port side of the expansion means 6 as a high pressure side of the reservoir 20, the solenoid valve 21 and the capillary tube 22. On the other hand, since the first solenoid valve 25 provided in the supplying pipe 26 which is communicated with the accumulator 9 is closed, no refrigerant is supplied from the reservoir 20 to the accumulator 9, and a superfluous amount of the refrigerant in the refrigeration cycle apparatus is gradually stored in the reservoir 20. By controlling the quantity of the refrigerant circulating in the refrigeration cycle in the manner as above-mentioned, the superheat SHI at the inlet side of the accumulator 9 becomes large, whereas the subcooling SC at the inlet side of the expansion means 6 becomes small, whereby the operational condition falls into the appropriate condition of the region C as shown in FIG. 3. Then, the valve control means 37 controls so that both the solenoid valves 21, 25 are closed.

Conversely, when the load of cooling is changed from a lower value to a greater value, the refrigeration cycle apparatus is operated under the condition of short of the refrigerant. Under the circumstances, the superheat SHI at the inlet side of the accumulator 9, which is processed by the processing unit 36 on the basis of the temperatures detected by the temperature elements 32, 33, 35 becomes large, and the subcooling SC at the inlet side of the expansion means 6 on the basis of the temperatures detected by the temperature elements 30, 31 becomes small. Namely, the operational condition falls into the region B in FIG. 3. In order to bring such operational condition into the appropriate condition shown by the region C, the second solenoid valve 21 is closed and the first one 25 is opened. As a result, the refrigerant in the reservoir 20 is fed to the accumulator 9 through the first solenoid valve 25 and the supplying pipe 26 because the position of the bottom of the accumulator 9 is lower than that of the reservoir 20. On the other hand, since the second solenoid valve 21 is closed, the flow of the refrigerant passing through the capillary tube 22 and the supplying pipe 23 is prevented. Thus, by controlling the quantity of the refrigerant circulating in the refrigeration cycle by feeding the superfluous refrigerant from the reservoir 20 to the accumulator 9, the superheat SHI at the inlet side of the accumulator 9 becomes small, and the subcooling SC at the inlet side of the expansion means 6 becomes large. Namely, the operational condition is regulated to fall into the region C in FIG. 3. As shown in FIG. 2, the valve control means 37 closes the solenoid valves 21, 25.

When the heating operation is to be carried out, the quantity of the refrigerant in the refrigeration cycle is controlled in accordance with the flow chart shown in FIG. 2 as is in the cooling operation.

If the operational condition in the heating mode is such that the superheat SHI at the inlet side of the accumulator 9, which is processed by the processing unit 36 on the basis of the temperatures detected by the temperature elements 30, 35 is small, and the subcooling SC at the inlet side of the expansion means 5, which is processed by the processing unit 36 on the basis of the temperatures detected by the temperature elements 32, 33, 34 is large, so that the operation is carried out under the condition that the refrigerant is superfluous, i.e. in the region A as shown in FIG. 3, the second solenoid valve 21 is opened and the first solenoid valve 25 is closed according to the program shown in the flow chart of FIG. 2. Accordingly, the refrigerant is entered to the reservoir 20 through the supplying pipe 23 via the inlet port side of the expansion means 5 as a high pressure side, the second solenoid valve 21 and the capillary tube 22. On the other hand, since the first solenoid valve 25 is closed, the refrigerant is not supplied from the reservoir 20 to the accumulator 9, and the superfluous amount of refrigerant in the refrigeration cycle apparatus is gradually stored in the reservoir 20. Thus, by controlling the quantity of the refrigerant, the superheat SHI at the inlet side of the accumulator, which is obtained by processing the temperatures detected by the temperature elements 30, 35 becomes large, and the subcooling SC at the inlet side of the expansion means 5, which is obtained by processing the temperatures detected by the temperature elements 32, 33, 34 becomes small, whereby the operational condition falls into the region C shown in FIG. 3. FIG. 2 shows that the valve control means 37 closes both the solenoid valves 21, 25 according to the program shown in the flow chart.

When the superheat SHI at the inlet side of the accumulator 9, which is obtained by processing the temperatures detected by the temperature elements 30, 35 is large, and the subcooling SC at the inlet side of the expansion means 5 which is obtained by processing the temperatures detected by the temperature element 32, 33, 34 is small, so that the operation is carried out under the condition as in the region B in FIG. 3, i.e. the refrigerant being short, the second solenoid valve 21 is closed while the first solenoid valve 25 is opened by the valve control means 37 according to the flow chart shown in FIG. 2. As a result, the refrigerant in the reservoir 20 flows into the accumulator 9 through the supplying pipe 26 with the first solenoid valve 25 in a open state because the position of the bottom of the accumulator is lower than that of the reservoir 20. On the other hand, the refrigerant does not flow through the supplying pipe 23 because the second solenoid valve 21 is closed. Thus, by controlling the quantity of the refrigerant in the refrigeration cycle by supplying the refrigerant from the reservoir 20 to the accumulator 9, the superheat SHI at the inlet side of the accumulator 9 becomes small, whereas the subcooling SC at the inlet side of the expansion means 5 becomes large. Namely, the operational condition falls in the region C as shown in FIG. 3. Then, the valve control means 37 closes both the first and second solenoid valve 21, 25 according to the program shown in the flow chart of FIG. 2.

As described above, according to the first embodiment of the present invention, an excessive amount of the refrigerant in the refrigeration cycle is stored in the reservoir through the supplying pipe when the refrigerant is superfluous, and an appropriate amount of the refrigerant is supplied through the supplying pipe when the refrigerant in the refrigeration cycle is short.

In the refrigeration cycle apparatus as shown in FIG. 1, when the operating cycle is switched, for instance, from the heating operation to the defrosting or cooling operation, the first solenoid valve 25 provided in the supplying pipe 26 is closed and the second solenoid valve 21 provided in the feeding pipe 23 is opened for a predetermined time before the switching of the operation mode. Then, the refrigerant is stored in the reservoir 20 through the feeding pipe 23. Accordingly, the quantity of the liquid refrigerant condensed in the utilizable heat exchangers 7, 8 becomes small. Under the circumstances, when both the solenoid valves 21, 25 are closed and the operating cycle is switched, the quantity of the liquid refrigerant flowing from the indoor heat exchangers 7, 8 through the four-way valve 3 to the accumulator 9 can be controlled to be small because the liquid refrigerant is previously stored in the reservoir 20, whereby there is no possibility that the liquid refrigerant is returned to the compressors 1, 2.

Similarly, when the operating cycle is switched from the defrosting or cooling operation to the heating operation, the first solenoid valve 25 is closed and the second solenoid valve 21 is opened for a predetermined time before the switching of the operation mode. Then, the refrigerant is stored in the reservoir 20 through the feeding pipe 23, whereby the quantity of the liquid refrigerant condensed in the outdoor heat exchanger 4 can be small. Under the circumstances, when both the solenoid valves 21, 25 are closed and the operating cycle is switched, the quantity of the liquid refrigerant flowing from the outdoor heat exchanger 4 through the four-way valve 3 to the accumulator 9 can be small because the liquid refrigerant is previously stored in the reservoir 20, and there is no possibility of returning the liquid refrigerant into the compressors 1, 2.

Since the accumulator 9 is connected to the reservoir 20 by the overflow pipe 24 at their upper part, the reservoir 20 can be used as an accumulator by closing the first and second solenoid valves 21, 25 when the operating cycle is switched.

Thus, by causing a flow of the refrigerant in the refrigerant circuit when the operating cycle is to be changed, the refrigerant is temporarily stored in the reservoir, and therefore, a flow of the liquid refrigerant to the accumulator is controlled when the operating cycle is changed, whereby liquid compression in the compressors can be prevented.

In the refrigeration cycle apparatus shown in FIG. 1, when the first solenoid valve 25 provided in the supplying pipe 26 is closed and the second solenoid valve 21 provided in the feeding pipe 23 is opened in a case that the operation of the apparatus is stopped, the refrigerant is fed to the reservoir 20 through the feeding pipe 23. As a result, the quantity of the liquid refrigerant stored in the indoor heat exchangers 7, 8 is small when the cooling operation is stopped. Also, the quantity of the liquid refrigerant stored in the outdoor heat exchanger 4 is small when the heating operation is stopped. Under the circumstances, when the first and second solenoid valves 21, 25 are closed and the compressors 1, 2 are started, the quantity of the liquid refrigerant flowing from the indoor heat exchangers 7, 8 to the accumulator 9 is reduced in the case that the cooling operation is carried out. Also, the quantity of the liquid refrigerant flowing from the outdoor heat exchanger 4 to the accumulator 9 is reduced in the case that the heating operation is carried out. Accordingly, there is no possibility of returning the liquid refrigerant into the compressors 1, 2. In this case, the reservoir 20 can be used as an accumulator because of the construction shown in FIG. 1.

Figure 4:
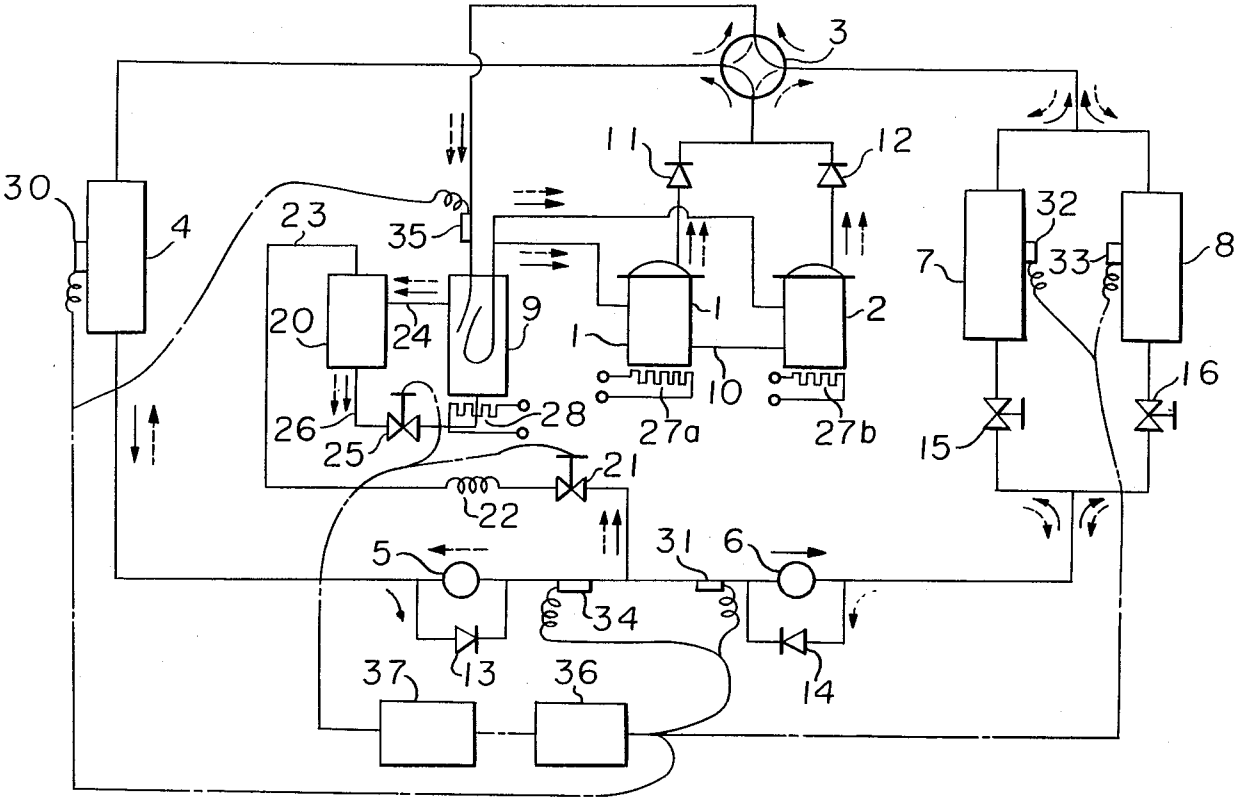
FIG. 4 is a diagram showing a second embodiment of the refrigeration cycle apparatus according to the present invention.

FIG. 4 shows a separate embodiment of the refrigeration cycle apparatus according to the present invention, wherein the same reference numerals as in FIG. 1 designate the same or corresponding parts, and therefore, description of these parts is omitted.

In this embodiment, the reservoir 20 as a recovering means for the superfluous refrigerant is placed at the lower pressure side and at the juxtaposition of the accumulator 9 in the refrigeration cycle apparatus, and the first and second compressors 1, 2 and the accumulator 9 are provided with respective heaters *27a, 27b, 28* at their lower part.

Figure 5:
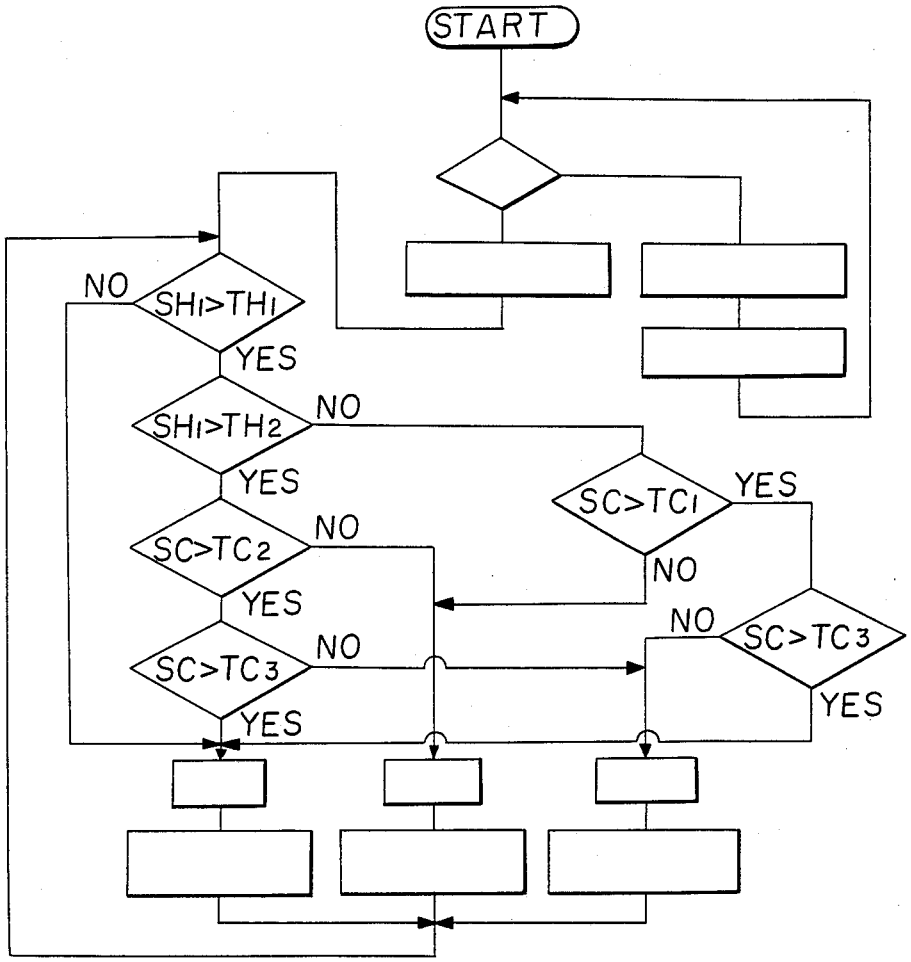
FIG. 5 is a flow chart for explaining the operation of the second embodiment.
Figure 6:
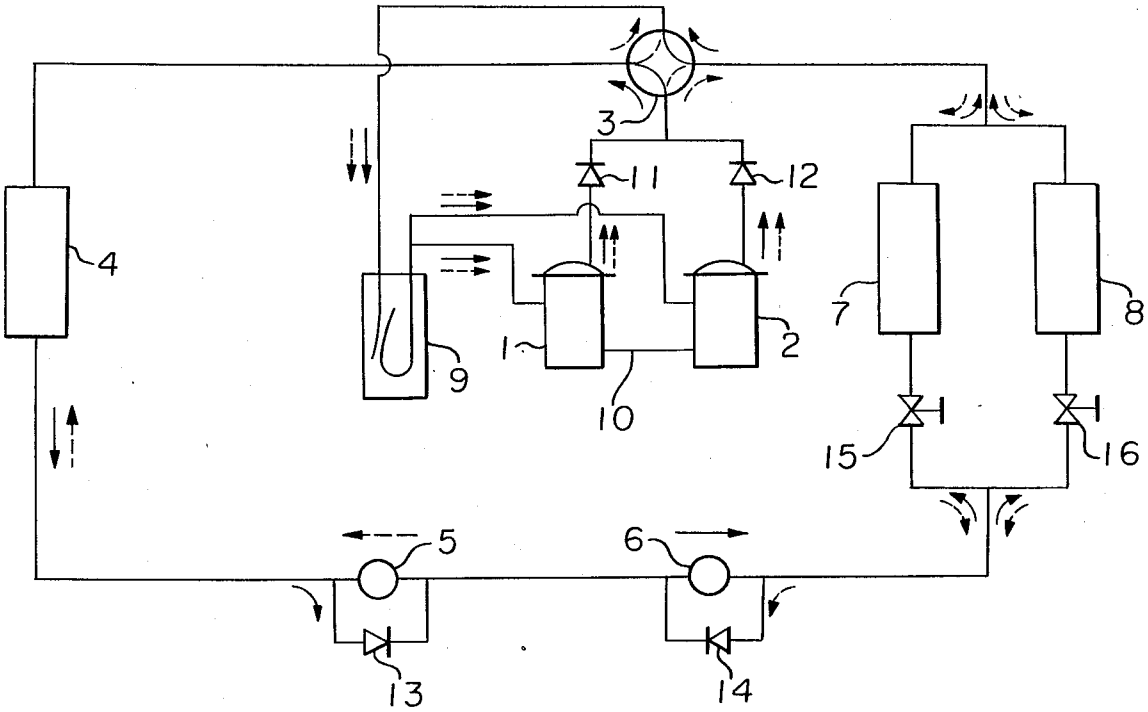
FIGURE 6 PRIOR ART
FIG. 6 is a diagram showing a conventional refrigeration cycle apparatus.

The operation of the refrigeration cycle apparatus having the construction as shown in FIG. 4 will be described with reference to FIGS. 3 and 5.

When the refrigeration cycle operation is stopped, the heaters *27a, 27b* and 28 are turned on and the first solenoid valve 25 is closed. Then, the liquid refrigerant in the compressors 1, 2 is evaporated and the gaseous refrigerant is fed to the accumulator 9 through a refrigerant piping. At the same time, the accumulator 9 is heated by the heater 28 and the refrigerant in the accumulator 9 is evaporated. The gaseous refrigerant in the accumulator 9 is entirely forwarded to the reservoir 20 through the overflow pipe 24. In this case, the first solenoid valve 25 provided in the supplying pipe 26 connected to the bottom of the reservoir 20 is closed.

Under the circumstances, when the refrigeration cycle operation is started, the heaters *27a, 27b, 28* are turned off. The subsequent operations are the same as those described in the first embodiment and with reference to the FIGS. 1 to 3, and therefore, explanation is omitted.

In the above-mentioned embodiment having the reservoir as a recovering means for the superfluous refrigerant and the heaters for the compressors and the accumulator, the liquid refrigerant which may stay in the compressors and the accumulator when the operation is stopped, is stored in the reservoir. Accordingly, fault of the compressors due to a liquid-back phenomenon when they are started can be eliminated, and an appropriate operating condition can be obtained even though a load of cooling or heating suddenly changed.

Obviously, numerous modifications and variations of the present invention are possible in light of the above teachings. It is therefore to be understood that within the scope of the appended claims, the invention may be practiced otherwise than as specifically described herein.

What is claimed is:

1. A refrigeration cycle apparatus which comprises first and second compressors, a four-way valve, a outdoor heat exchanger, first and second expansion means, at least one indoor heat exchanger, an accumulator, a refrigerant circuit connecting these element in order, a reservoir connected to said accumulator through an overflow pipe and a refrigerant supplying pipe with a first solenoid valve and a feeding pipe with a second solenoid valve for connecting the inlet side of said expansion means to said reservoir, wherein said first and second solenoid valves are opened and closed on the basis of operational conditions in a refrigeration cycle.

2. The refrigeration cycle apparatus according to claim 1, wherein said first and second solenoid values are opened and closed depending on superheat or supercooling condition.

3. The refrigeration cycle apparatus according to claim 1, wherein said first solenoid valve is closed and said second solenoid valve is opened for a predetermined time before said refrigeration cycle is switched from a first operating mode to a second operating mode by means of said four-way valve, and said first and second solenoid valves are closed as soon as said four-way valve is operated for switching.

4. The refrigeration cycle apparatus according to claim 1, wherein when said compressors are stopped, said first solenoid valve is closed while said second solenoid valve is opened, and when said compressors are started, said first and second solenoid valves are closed.

5. The refrigeration cycle apparatus according to claim 1, wherein an electric heater is provided at the bottom of each of said compressors and said accumulator.

6. The refrigeration cycle apparatus according to claim 1, which comprises temperature elements for detecting condensing temperature or evaporating temperature, temperature elements for detecting refrigerant temperature at the inlet side of said first and second expansion means, a temperature element for detecting refrigerant temperature at the inlet side of said accumulator, a processing means for processing the subcooling in said first expansion means during a cooling operation mode or the subcooling rate in said second expansion means and the superheat at the inlet side of said accumulator during a heating operation mode on the basis of data on the temperatures, and a valve control means for controlling opening and closing operations of said first and second solenoid valves depending on the subcooling or the superheating calculated by said processing means.

7. The refrigeration cycle apparatus according to claim 1, wherein said reservoir is placed in such a position that the bottom of said reservoir is higher than the bottom of said accumulator.

8. The refrigeration cycle apparatus according to claim 1, wherein said refrigerant supplying pipe connects both the bottom of said reservoir and said accumulator, and said overflow tube connects them at a higher position than said supplying pipe.

* * * * *